US009386818B2

(12) United States Patent
Rensink et al.

(10) Patent No.: US 9,386,818 B2
(45) Date of Patent: Jul. 12, 2016

(54) HELMET AND HELMET ELEMENT FOR USE IN A HELMET

(75) Inventors: Pim Rensink, Utrecht (NL); Mark Wilhelmus Theresia Van Tilburg, Son (NL); Aernout Johan Korneel Oudenhuijzen, Amersfoort (NL)

(73) Assignee: Nederlandse Organisatie voor toegepast-natuurwetenschappelijk onderzoek TNO, Delft (NL)

( * ) Notice: Subject to any disclaimer, the term of this patent is extended or adjusted under 35 U.S.C. 154(b) by 463 days.

(21) Appl. No.: 13/574,379

(22) PCT Filed: Jan. 21, 2011

(86) PCT No.: PCT/NL2011/050038
§ 371 (c)(1),
(2), (4) Date: Sep. 14, 2012

(87) PCT Pub. No.: WO2011/090381
PCT Pub. Date: Jul. 28, 2011

(65) Prior Publication Data

US 2013/0167289 A1 Jul. 4, 2013

(30) Foreign Application Priority Data

Jan. 22, 2010 (EP) ..... 10151427

(51) Int. Cl.
*A42B 3/08* (2006.01)
*A42B 3/04* (2006.01)
(Continued)

(52) U.S. Cl.
CPC . *A42B 3/08* (2013.01); *A42B 3/127* (2013.01); *A42B 3/145* (2013.01)

(58) Field of Classification Search
CPC ..... A42B 3/12; A42B 3/125; A42B 3/127; A42B 3/128; A42B 3/145; A42B 3/14; A42B 3/04; A42B 3/08; A42B 3/142; F16F 1/025; F16F 1/027; F16F 1/18; F16F 1/182; F16F 1/185; F16F 1/20; F16F 1/22; F16F 1/26; F16F 1/28; F16F 1/30
USPC ..... 2/421, 411, 412, 414, 416, 417–420; 267/158, 160, 161, 164, 140.4, 140.3; 132/278
See application file for complete search history.

(56) References Cited

U.S. PATENT DOCUMENTS 2,710,965 A * 6/1955 Bowers ..... 2/417
3,065,288 A * 11/1962 Smith et al. ..... 429/66
(Continued)

FOREIGN PATENT DOCUMENTS

CA 2260549 8/2000
DE 847811 8/1952
(Continued)

OTHER PUBLICATIONS

International Search Report—PCT/NL2011/050038—Mailing date: May 6, 2011.

*Primary Examiner* — Amy Vanatta
(74) *Attorney, Agent, or Firm* — Banner & Witcoff, Ltd.

(57) ABSTRACT

Helmet element (1) for, as a component of a helmet which is provided with a helmet shell (7) and a cranium strap (9) for enclosing the user's cranium, providing a connection between said cranium strap and helmet shell, which helmet element comprises a leave springs connected to the helmet shell and the cranium strap. Ends of the leave springs are connected together, leaving an eye between the leave springs. The leaf springs are connected to the helmet shell (13) and the cranium strap (11) respectively. A buffer member (3) may be provided as a spacer in the eye between the leaf springs. The buffer member (3) may be made of foam material.

19 Claims, 2 Drawing Sheets

(51) Int. Cl.
*A42B 3/12* (2006.01)
*A42B 3/14* (2006.01)

(56) References Cited

U.S. PATENT DOCUMENTS

| | | | | | |
|---|---|---|---|---|---|
| 3,089,144 | A | * | 5/1963 | Cherup | 2/414 |
| 3,416,783 | A | * | 12/1968 | Tondato | 267/33 |
| 3,605,113 | A | * | 9/1971 | Marietta | 2/420 |
| 3,650,520 | A | * | 3/1972 | Vernon et al. | 267/152 |
| 3,866,243 | A | * | 2/1975 | Morgan | 2/418 |
| 4,407,021 | A | * | 10/1983 | Kralik et al. | 2/416 |
| 4,472,472 | A | * | 9/1984 | Schultz | 428/178 |
| 4,736,932 | A | * | 4/1988 | Haslim | 188/83 |
| 4,843,737 | A | * | 7/1989 | Vorderer | 36/38 |
| 4,869,479 | A | * | 9/1989 | Colonel et al. | 267/158 |
| 4,910,884 | A | * | 3/1990 | Lindh et al. | 36/28 |
| 5,102,107 | A | * | 4/1992 | Simon et al. | 267/152 |
| 5,204,998 | A | * | 4/1993 | Liu | 2/411 |
| 6,081,931 | A | | 7/2000 | Burns et al. | |
| 6,401,260 | B1 | * | 6/2002 | Porth | 2/411 |
| 7,222,374 | B2 | * | 5/2007 | Musal et al. | 2/421 |
| 8,039,078 | B2 | * | 10/2011 | Moore et al. | 428/76 |
| 8,850,622 | B2 | * | 10/2014 | Finiel et al. | 2/410 |
| 2005/0015856 | A1 | | 1/2005 | Long | |
| 2005/0262619 | A1 | * | 12/2005 | Musal et al. | 2/421 |
| 2010/0319109 | A1 | * | 12/2010 | Field | 2/421 |

FOREIGN PATENT DOCUMENTS

| | | |
|---|---|---|
| DE | 921777 | 12/1954 |
| FR | 1193925 | 11/1959 |

* cited by examiner

HELMET AND HELMET ELEMENT FOR USE IN A HELMET

CROSS-REFERENCE TO RELATED APPLICATIONS

This application is a U.S. National Stage application under 35 U.S.C. §371 of International Application PCT/NL2011/050038 (published as WO 2011/090381 A1), filed Jan. 21, 2011 which claims priority to Application EP 10151427.1, filed Jan. 22, 2010. Benefit of the filing date of each of these prior applications is hereby claimed. Each of these prior applications is hereby incorporated by reference in its entirety.

FIELD OF THE INVENTION

The invention relates to a helmet and a helmet element for use in the helmet. The invention also relates to a kit of parts, comprising the helmet and a set of buffer members, as well as a method of adjusting head fit of a helmet.

BACKGROUND

In military combat helmets different types of interior structures may be used i.e. various strap, cushion, foam upholstering and dot systems. The interior structures fulfil—among others—the function of fit, stability and impact absorption.

DE 921 777 describes a helmet with a cranium strap that runs around the user's cranium. The helmet shell is connected to the cranium strap via intermediate elements that each comprises an elastic material and two metal plates vulcanized to opposite sides of the elastic material. Rivets connect the metal plates to the helmet shell and cranium strap respectively. The metal plates and the rivets function to attach the helmet and cranium strap to the elastic material, which is vulcanized to the metal plates. When an object impacts on the helmet shell, the metal plates transfer to the impact force to the elastic material, thereby compressing the elastic material so that part of the impact energy is absorbed.

The helmet of a combat soldier primarily protects the head against ballistic threats (bullets and fragments) and against "blunt impact" (falling/bumping). Besides, the helmet more and more is used as a platform to which parts can be attached, like sensors, interfaces and other peripheral equipment. For the performance and security of the user it is important that the helmet is seated on the user's head in a comfortable and stable way. The interior structure of the helmet plays an important role in the helmet's fit: it forms the interface between the helmet shell and the user's head. In the interior structure many functions are combined:

- fitting to the user's head size and shape by adaptation of the interior structure;
- absorbing impact of energy in case of falling and bumping;
- stabilizing the helmet relative to the head by minimalisation of the motions (rotations and translations);
- spacing the helmet shell from the cranium in order to allow indentation in case of impact of a projectile (sometimes called "stand-off");
- ventilation by providing free air flow in order to drain warm, humid air;
- force transfer by transferring the mass of the helmet to the cranium Some requirements conflict one another: a helmet has to be stable on the head, which means that a helmet is hardly allowed to rotate and translate relative to the head; for impact absorption, however, it is necessary that the helmet shell is connected to the interior structure independently of the head, allowing it to move relative to the head. For a good fit and wear comfort it is necessary that the interior structure is adjusted so that it fits well to the shape and size of the head, where the interior structure has to be secured after being adjusted so that the size setting remains unaltered during use of the helmet. This setting, on one hand, has to be rigid enough to create a stable helmet and, on the other hand, flexible enough to be dented on impact.

In the helmet of DE 921 777 the blocks of elastic material absorb the impact energy. The metal plates on opposite sides of the elastic material are used to transmit the forces to the elastic material. The metal plates are only coupled to each other via the elastic material.

The helmet of DE 921 777 has the disadvantage that it is difficult to adapt the fit of the helmet to the user's head. Different size helmets must be provided for different users, or helmets with intermediate elements with different size blocks of elastic material would have to be provided, riveted to the helmet shell and the cranium strap.

SUMMARY

It is an object to provide a stable helmet having improved fit and improved wear comfort without negative effects to impact absorption.

It is an alternative object to provide an improved interconnection member between the interior structure and the helmet shell including a head width adjusting mechanism, where sufficient helmet stability and impact stability remains guaranteed.

A helmet element is provided as a component of a helmet which is provided with a helmet shell and a cranium strap for encircling the user's cranium, providing a connection between said cranium strap and helmet shell, the helmet element comprising

- a first spring member, connected to the helmet shell, the first spring member comprising a first leaf spring extending between first and second ends of the first leave spring; and
- a second spring member, connected to the cranium strap, the second spring member comprising a second leaf spring extending between first and second ends of the second leave spring, the first ends of the first and second leaf spring being coupled to each other and the second ends of the first and second leaf spring being coupled to each other, leaving a space between parts of the first and second leave spring between the connected first and second ends.

The space between the leave springs forms an eye (i.e. a space that narrows in two directions from the centre) that can be widened to different sizes, as needed to fit the support of the helmet shell to different head sizes.

The helmet element may further comprise a buffer member, in the eye between the leave springs. The leave springs allow for insertion buffer members having different thicknesses and/or densities. In this way the thickness can be adjusted. The buffer member is a block of material (not necessarily a rectangular block), preferably of a compressible material such as an elastically compressible material. Preferably, the buffer member is made from a foamy synthetic material or rubber.

A helmet is provided that comprises at least one and preferably a plurality of such helmet elements, between the cranium strap and the helmet shell. Preferably, the helmet elements are applied on the sides of the helmet, on one side connected to the cranium strap and on the other side to the helmet shell.

A kit of parts is provided, comprising the helmet and a set of buffer members of mutually different thicknesses and/or densities. Such a kit of parts makes it possible to select a buffer member and insert it in the eye between the leave springs in order to fit the helmet to the size of a user's head.

A method of fitting a helmet is provided that comprises inserting a buffer members in the eyes of one or more helmet elements while fitting the helmet to the head of a user.

BRIEF DESCRIPTION OF THE DRAWING

These and other objects and advantageous aspects will become apparent from a description of exemplary embodiments, using the following figures.

DETAILED DESCRIPTION OF EXEMPLARY EMBODIMENTS

Figure 1:
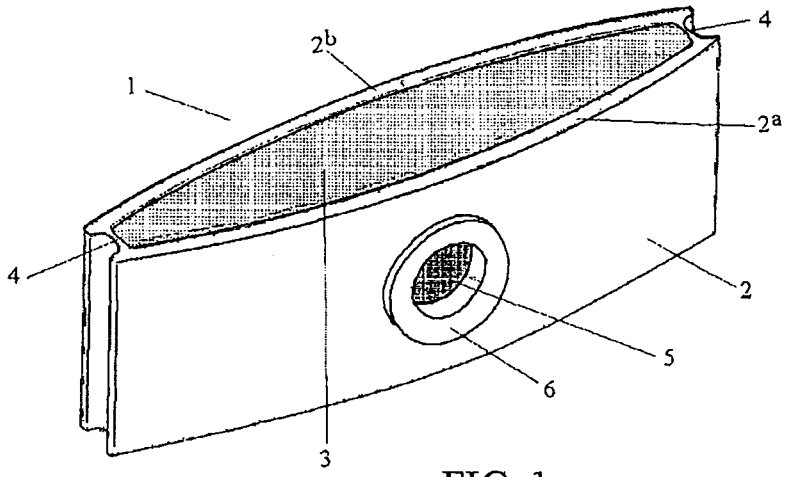
FIG. 1 shows a helmet element.

FIG. 1 shows an embodiment of a helmet element 1. In this embodiment the helmet element is constituted by a thermoplastic spring member 2 e.g. made from a thermoplastic synthetic material, filled with a buffer member 3 from e.g. a foam material. The spring member has the shape of two curved leaf springs 2*a*, 2*b* in mirror image which are interconnected one another via bridge parts 4 at their ends, and thus forms a holder or housing for the buffer member 3. In x-direction (forward-backward) the size of the leaf form and the foam is much larger than in the y-direction (left-right). The whole is deformable in principle; however, due to the construction this will be easier in y-direction than in x-direction.

In the centre of each curved leaf spring 2 the helmet element 1 is provided with a mounting opening 5, surrounded by a spacing collar 6. On one side of the helmet element 1 het helmet element 1 is, on one side, by means of the mounting opening 5 and spaced by the spacing collar 6, connected to the helmet shell, and is, on the other side, connected to a cranium strap (provided with a soft layer), which encloses the user's cranium, i.e. it runs in a band around the user's head.

Figure 2:
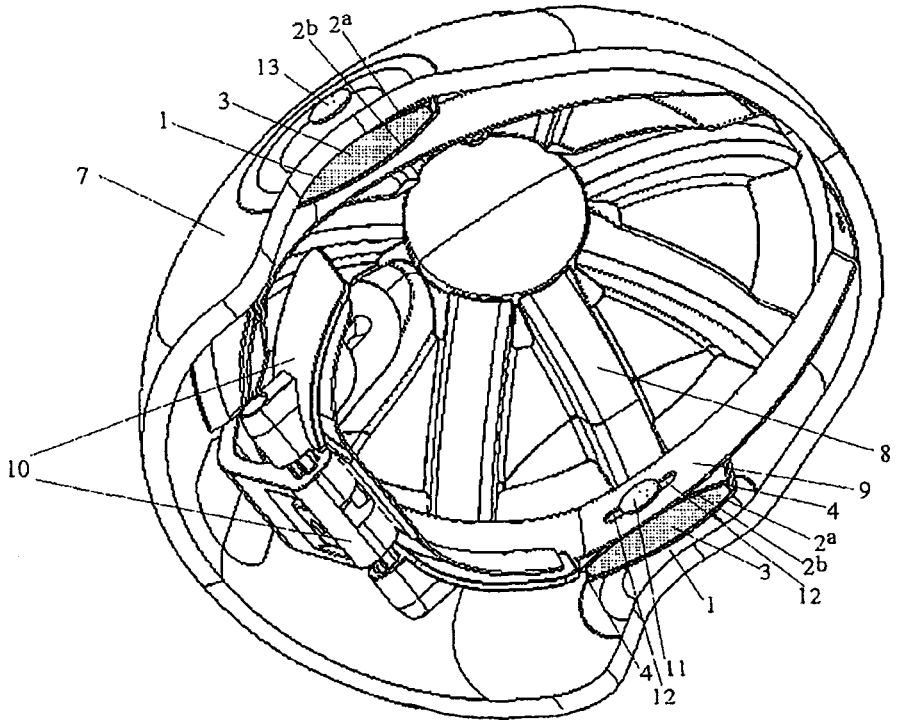
FIG. 2 shows a helmet with helmet elements of FIG. 1 applied on its sides.

FIG. 2 shows a helmet including a helmet shell 7 and an interior structure 8, including a cranium strap 9, which is cushioned with a soft lining, e.g. of foam, (not visible in the figure) applied on the side of the user's cranium. Moreover, the helmet shown in FIG. 2 is provided with a bracket shaped neck support member 10. Inside, on both sides of the helmet elements 1 are provided as shown in FIG. 1, each consisting of a set of integrated curved leaf springs 2*a*, 2*b* and bridge parts 4 and filled with—exchangeable—buffer members 3. On one side the helmet elements 1 are connected to the cranium strap by means of connection members 11 extending through the openings 5 in the relevant spring members 2 and through slotted openings 12 in the cranium strap 9. On the other side the helmet elements 1 are connected to the helmet shell 7 by means of connection members 13, extending through the openings 5 and openings in the helmet shell 7.

The connection between the helmet element 1 and the cranium strap 9 allows translation in x-direction, necessary for increasing or decreasing the girth of the cranium strap. By enabling, using the shown configuration, to choose from buffer members 3 having different foam thicknesses in x-direction, it is possible to set or adjust the distance between the head and the helmet shell. The number of different foam thicknesses depends on the adjustment range of the helmet size.

A user may be supplied with the helmet and a set of a plurality of buffer members 3 having mutually different foam thicknesses in the x-direction and/or mutually different densities. In order to adjust the helmet to a head, the user may select a buffer member from the set and inserted it in the space between the leaf springs. In certain cases, for example for the largest heads, the buffer members may even be omitted.

Preferably the buffer members 3 are made of compressible material, for example elastically compressible material or a material that deforms inelastically for example by crumbling under a large force. Each buffer member may have an eye shaped cross-section, with a relatively thicker part in the centre and narrower parts on the side, so as to substantially fill a cross-section of the space between the leave springs. However, alternatively a different shape may be used, which fills only part of the cross-section, preferably at least a part that includes the space midway between the interconnections between the leaf springs. In the direction transverse to the eye shaped cross-section each buffer member will have a certain non-zero height. The leave springs may have equal width in a direction parallel to the interconnections between the leaf springs. In an embodiment the height of the buffer member may be equal to the width of the leaf springs, so that the entire space can be filled. But it is also possible to use larger or smaller heights and to fill only part of the space, or let the buffer member extend from the space. In an embodiment a buffer member may be composed of a plurality of sub elements between the leaf springs, for example to fit the helmet by inserting a selectable number of sub elements between the leaf springs.

Although the use of a plurality of helmet elements in a helmet has been shown, it should be understood that a helmet with only one such helmet element may be used to provide for fitting the helmet over a limited range of head sizes or shapes.

By means of the shape of the helmet element 1, the rigidity of the foam of the buffer member 3 and the shape (the thickness and/or the length) of it an optimum can be realised between the required stability of the helmet and its impact absorption. Besides the helmet element 1 absorbs push- and pull forces in y-direction, due to which no mutual displacement between the head and the helmet shell 7 can occur and the helmet thus remains stable on the user's head. On large forces, e.g. in case of falling or bumping ("impact"), the helmet element 1 can spring inwardly, i.e. be compressed. Due to this the distance between the helmet shell and the head will become smaller causing the foam material applied to the inside of the helmet shell to come into contact with the head and to deform, causing the impact energy to be absorbed.

The helmet element thus forms an adjustable and elastic bridge between the helmet shell 7 on one side and the cranium strap 9 of the helmet on the other side. In particular also the connection to the cranium strap is of importance as the use of a cranium strap is necessary for a stable helmet. Besides to the spring members 1 on the left and right side, the cranium strap is also connected to the front side of the helmet shell 7 and to the back side to the occiput support 10. As already stated, at the locations in the helmet shell which are still free, special foam may be applied, which deforms on large forces caused by impact.

According to one aspect a helmet element (1) is provided for, as a component of a helmet which is provided with a helmet shell (7) and a cranium strap (9) for enclosing the user's cranium, providing a connection between said cranium strap and helmet shell, the helmet element comprising a first spring member (2*a*), connected to the helmet shell, and a second spring member (2*b*), connected to the cranium strap, which first and second spring members each are constituted for a substantial part by a leaf spring. A helmet is provided with a plurality of the helmet elements (1) applied on the sides of said helmet, and, on one side, connected to the cranium strap (9) and, on the other side, to the helmet shell (7).

In an embodiment the leaf springs of both spring members (2*a*, 2*b*) are connected to the helmet shell (5; 13) and the cranium strap (5;11) respectively mainly in their centre and wherein they are interconnected one another (4) directly or indirectly at their ends. In a further embodiment said ends are interconnected one another directly and the first and second spring members form one integral spring member (2). In a yet further embodiment the integral spring member is made from a thermoplastic or thermosetting synthetic material The helmet element may comprise a buffer member (3) mainly between the first and second spring members. In an embodiment the first and second spring members are arranged to allow the installation of buffer members having different thicknesses and/or densities. The buffer member may be made from a foamy synthetic material or rubber.

Figure 3:
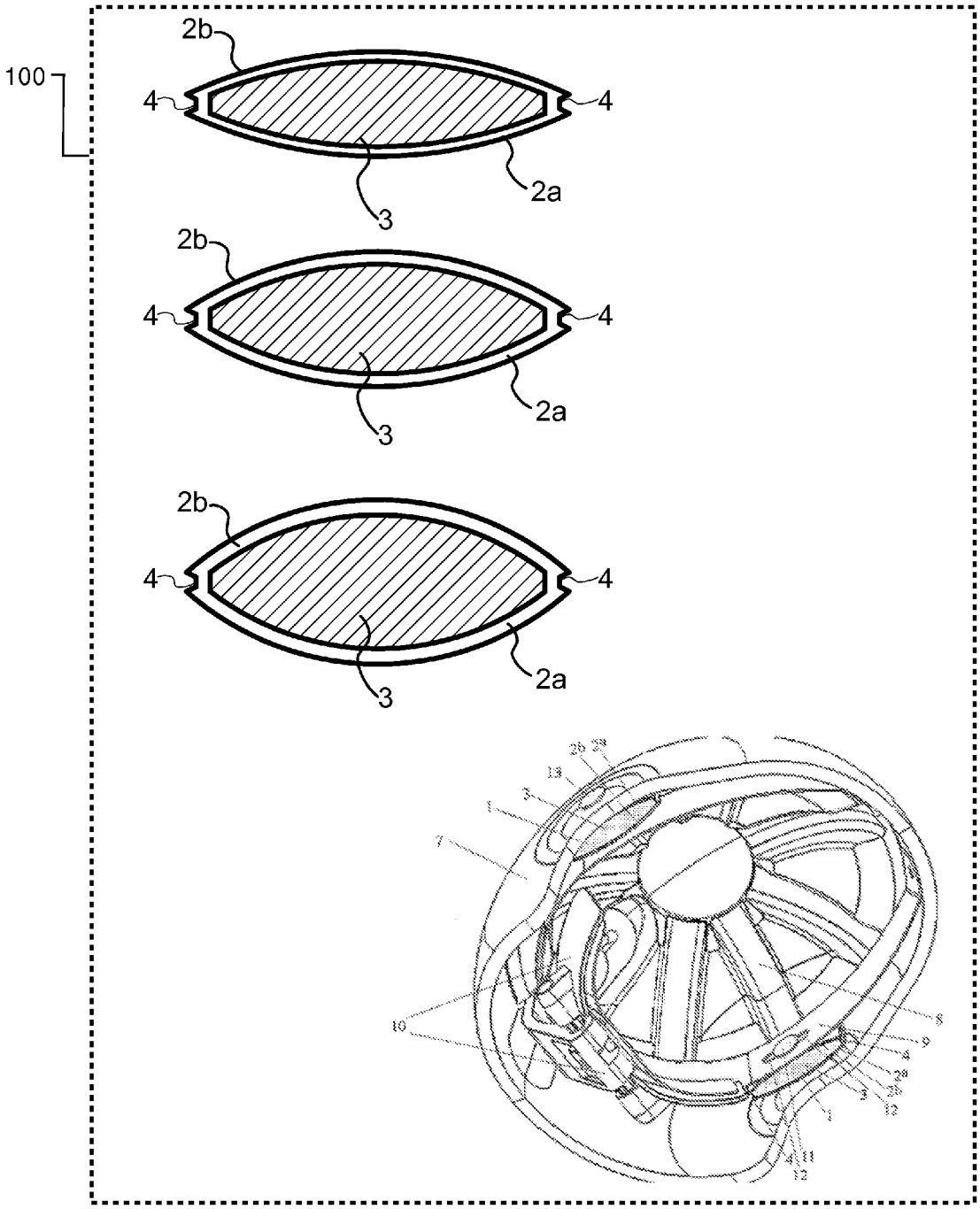
FIG. 3 shows a kit of parts, comprising a helmet and a set of buffer members of mutually different thicknesses and/or densities.

FIG. 3 shows a kit of parts 100, comprising a helmet as shown in FIG. 2 and a set of buffer members 3, as shown in FIG. 1, of mutually different thicknesses and/or densities.

The invention claimed is:

1. A helmet element for use as a component of a helmet which is provided with a helmet shell and a cranium strap for encircling the user's cranium, the helmet element providing a connection between said cranium strap and helmet shell, the helmet element comprising a first spring member comprising a first leaf spring extending between first and second ends of the first leaf spring; and a second spring member comprising a second leaf spring extending between first and second ends of the second leaf spring, the first ends of the first and second leaf spring being coupled to each other and the second ends of the first and second leaf spring being coupled to each other, the first and second leaf springs having curved surfaces that form a space between parts of the first and second leaf spring, wherein the space narrows in two directions from the center of the space toward the connected first and second ends, wherein the first and second leaf springs are interconnected directly at their first and second ends, wherein the first leaf spring includes a first mounting opening configured to connect to the helmet shell and the second leaf spring includes a second mounting opening configured to connect to the cranium strap, and wherein a first spacing collar, integral with the first leaf spring and protruding from the curved surface of the first leaf spring and away from the space, encircles the first mounting opening and a second spacing collar, integral with the second leaf spring and protruding from the curved surface of the second leaf spring and away from the space, encircles the second mounting opening.

2. A helmet element according to claim 1, comprising a buffer member located at least partly in said space between the first and second leaf spring.

3. A helmet element according to claim 2, wherein the first and second spring members are configured to allow the installation of buffer members having different thicknesses and/or densities between the leaf springs.

4. A helmet element according to claim 2, wherein the buffer member is made from a foamy synthetic material or rubber.

5. A helmet element according to claim 1, wherein the first and second mounting openings are configured to connect to the helmet shell and the cranium strap respectively, at positions between the first and second ends.

6. A helmet element according to claim 5, wherein the first and second mounting openings are configured to connect to the helmet shell and the cranium strap respectively, at positions substantially midway between the first and second ends.

7. A helmet element according to claim 1, wherein the first and second leaf spring form an integral spring member, made of a thermoplastic or thermosetting synthetic material.

8. A helmet element as claimed in claim 1, wherein the first and second leaf springs form an integral spring member, the first and second leaf spring being integrally interconnected at their first and second ends.

9. A helmet, comprising a helmet shell, a cranium strap for encircling the user's cranium, and at least one helmet element connected to the helmet shell and to the cranium strap, the helmet element comprising a first spring member, connected to the helmet shell, the first spring member comprising a first leaf spring extending between first and second ends of the first leaf spring; and a second spring member, connected to the cranium strap, the second spring member comprising a second leaf spring extending between first and second ends of the second leaf spring, the first ends of the first and second leaf spring being coupled to each other and the second ends of the first and second leaf spring being coupled to each other, leaving a space between parts of the first and second leaf spring between the connected first and second ends, wherein the first and second leaf springs are interconnected directly at their first and second ends.

10. A helmet according to claim 9, comprising a plurality of helmet elements at mutually different positions along the cranium strap.

11. A kit, comprising the helmet of claim 9, and a set of buffer members of respective different thicknesses and/or densities, and/or parts suitable for composing buffer members of respective different thicknesses and/or densities, wherein the buffer members are configured for insertion in the space between the first and second leaf spring.

12. A method of adjusting head fit of a helmet that comprises a helmet shell and a cranium strap for enclosing the user's cranium, and at least one helmet element connecting said cranium strap and helmet shell, wherein the helmet element comprises first and second spring members, connected to the helmet shell and the cranium strap respectively, the first and second spring members comprising leaf springs interconnected directly at their respective first and second ends, leaving a space of eye-shaped cross-section between the leaf springs, the adjustment comprising fitting the helmet to the head of a user by inserting a buffer member of a selected thickness and/or density in said space between the first and second leaf spring.

13. A helmet comprising a helmet shell, a cranium strap for encircling the user's cranium, and a helmet element providing a connection between said cranium strap and helmet shell, the helmet element comprising a first spring member, connected to the helmet shell, the first spring member comprising a first leaf spring extending between first and second ends of the first leaf spring; and a second spring member, connected to the cranium strap, the second spring member comprising a second leaf spring extending between first and second ends of the second leaf spring, and a buffer member located between the first and second leaf spring, wherein the first ends of the first and second leaf spring are coupled to each other outside the buffer member and the second ends of the first and second leaf spring being coupled to each other outside the buffer member, leaving a space between parts of the first and second leaf spring between the connected first and second ends, the buffer member being located at least partly in said space.

14. A helmet comprising a helmet shell, a cranium strap for encircling the user's cranium, and a helmet element providing a connection between said cranium strap and helmet shell, the helmet element comprising a first spring member, connected to the helmet shell, the first spring member comprising a first leaf spring extending between first and second ends of the first leaf spring; and a second spring member, connected to the cranium strap, the second spring member comprising a second leaf spring extending between first and second ends of the second leaf spring, the first ends of the first and second leaf spring being coupled to each other and the second ends of the first and second leaf spring being coupled to each other, leaving a space between parts of the first and second leaf spring between the connected first and second ends, wherein the first and second leaf springs form an integral spring member, the first and second leaf spring being integrally interconnected at their first and second ends.

15. A cranium strap assembly for use in a helmet, the cranium strap assembly comprising a cranium strap for encircling the user's cranium, a helmet element connected to the cranium strap, the helmet element configured to provide a connection between said cranium strap and a helmet shell, the helmet element comprising a first spring member comprising a first leaf spring extending between first and second ends of the first leaf spring; and a second spring member, connected to the cranium strap, the second spring member comprising a second leaf spring extending between first and second ends of the second leaf spring, the first ends of the first and second leaf spring being coupled to each other and the second ends of the first and second leaf spring being coupled to each other, leaving a space between parts of the first and second leaf spring between the connected first and second ends, wherein the first and second leaf springs are interconnected directly at their first and second ends.

16. The cranium strap assembly of claim 15, further comprising a buffer member located at least partly in said space between the first and second leaf spring.

17. The cranium strap assembly of claim 16, wherein the first and second spring members are configured to allow the installation of buffer members having different thicknesses and/or densities between the leaf springs.

18. The cranium strap assembly of claim 16, wherein the buffer member is made from a foamy synthetic material or rubber.

19. The cranium strap assembly of claim 15, wherein the first and second leaf spring form an integral spring member, made of a thermoplastic or thermosetting synthetic material.

* * * * *